United States Patent [19]

Harvey

[11] Patent Number: 4,707,637

[45] Date of Patent: Nov. 17, 1987

[54] PLASMA-ANODE ELECTRON GUN

[75] Inventor: Robin J. Harvey, Thousand Oaks, Calif.

[73] Assignee: Hughes Aircraft Company, Los Angeles, Calif.

[21] Appl. No.: 842,960

[22] Filed: Mar. 24, 1986

[51] Int. Cl.[4] ..... H01J 7/24; H05B 31/26

[52] U.S. Cl. ..... 315/111.81; 315/111.31; 315/111.41; 313/231.31

[58] Field of Search ..... 315/111.31, 111.41, 315/111.81, 111.91, 337, 339; 313/231.31, 231.41

[56] References Cited

U.S. PATENT DOCUMENTS

| | | | |
|---|---|---|---|
| 3,411,035 | 11/1968 | Necker et al. | 315/111.81 |
| 3,970,892 | 7/1976 | Wakalopulos | 315/111.31 |
| 4,025,818 | 5/1977 | Giguere et al. | 315/337 |
| 4,570,106 | 2/1986 | Sohval et al. | 315/111.81 |
| 4,642,522 | 2/1987 | Harvey et al. | 315/111.81 |
| 4,645,978 | 2/1987 | Harvey et al. | 315/111.81 |

*Primary Examiner*—Saxfield Chatmon

*Attorney, Agent, or Firm*—Terje Gudmestad; A. W. Karambelas

[57] ABSTRACT

A plasma-anode electron gun includes a cathode means of a material such as molybdenum having a relatively high ratio of emission of secondary electrons to impinging helium ions. A hollow annular anode structure (16) contains an ionized plasma, and has a central opening (38) through which the electron beam (36) is directed, when ions from the anode are released to impinge upon the cathode (12). The anode and ion source structure may be grounded, and ions are released through openings facing the cathode when a positive trigger pulse is applied to one or more electrodes extending within the plasma. The cathode is preferably operated at a voltage in the order of thirty to two hundred thousand volts negative with respect to the cathode. Leakage of ions from the hollow anode may be inhibited by the provision of a supplemental grid biased to a low positive potential.

25 Claims, 11 Drawing Figures

PLASMA-ANODE ELECTRON GUN

FIELD OF THE INVENTION

This invention relates to cold cathode electron sources and more particularly to cold cathode electron sources for free electron lasers (FEL), klystrons, travelling wave tubes and gyroklystrons.

BACKGROUND OF THE INVENTION

Conventional practice for the generation of electron beams for linear accelerators, free electron lasers, and gyrotrons utilizes thermionic cathodes, or pulsed "cold cathode" sources such as plasma cathodes and field emitters. However, thermionic cathodes are limited in current density, require heater power, radiate heat, and are susceptible to poisoning; and pulsed high voltage diodes emit higher currents but they operate for only a few microseconds at most, and at low duty cycle. Grid control of the conventional sources is also difficult since the grid must operate at the high voltage of the cathode.

Accordingly, a principal object of the present invention is to provide a high density electron beam without the many problems normally associated with thermionic cathodes.

SUMMARY OF THE INVENTION

In accordance with the present invention, a cold cathode is employed which is formed of a material having a relatively high ratio of emission of secondary electrons to impinging ions. A combined anode and ion source may include an annular chamber for containing a gas plasma and arrangements for selectively releasing ions to impinge upon the cathode, thereby generating secondary electrons. The anode may be hollow, as noted above, and may have a central opening, and the electrons are directed through the opening in the anode to form an electron beam.

Additional features and collateral aspects of the invention may include any of the following:

1. The cathode may be at a very substantial negative potential, such as several tens of kilovolts or to 100 kilovolts or more negative with regard to the combined anode and plasma source. The ratio of secondary electrons to incident ions may be in the order of 14 or 15 electrons per ion, with a cathode potential in the order of −100 kilovolts.

2. In one embodiment the cathode may be relatively flat or slightly dished in the manner of a conventional Pierce thermionic cathode, and the annular anode electrode may release ions to impinge inwardly on the cathode structure, whereas the emitted electrons may be drawn back toward the combined anode and ion source and pass through the central opening thereof, to form a focused electron beam along the axis. In this process the electrons travel along significantly different trajectories from the ions, which are coming in toward the cathode peripherally and are arranged to bombard the cathode according to the desired electronic emission density.

3. In another alternative geometry, suitable for gyrotron applications, the plasma source may be substantially cylindrical, and direct ions inwardly to a correspondingly cylindrical inner cold cathode, from which the electrons are first emitted and then directed axially by the combined action of the electric and negative fields to form a beam to be employed for the gyrotron, under the control of an axial magnetic field.

4. Pulses of ions may be controlled by one or more wire-anode control electrodes extending into the plasma chamber, which is filled with a low pressure gas such as helium. When the control electrode is pulsed, for example, to a positive voltage in the order of a kilovolt, plasma electrons are trapped by the electric fields of the wire and ionize the gas by the wire-ion-plasma mechanism, with the resulting ions being ejected from openings facing the cathode; as in U.S. Pat. No. 3,949,260, which issued to J. R. Bayless and Robin Harvey.

5. A supplemental grid electrode at a relatively low positive voltage such as 50 to 100 volts, may also be provided adjacent the openings in the ion source and anode which face the cathode, to preclude leakage of the ions during the formation or decay of the plasma in the plasma chamber, thus sharpening or modulating the pulse wave form of the ion beam.

6. In an alternative embodiment, the ion source may be divided into two coupled chambers, and release of ions may be accomplished by pulsing an electrode in the rear chamber remote from the openings facing the cathode.

7. In an alternative embodiment, supplemental magnets may be employed to facilitate the establishment of a plasma by the crossed-field discharge mechanism within the ion source by trapping the plasma electrons and increasing the formation of ions within the annular ion source.

8. In an alternative embodiment, the energy of the ions bombarding the cathode is optimized for maximum secondary yield and minimum power dissipation on the cathode by providing for operation of the ion source as an intermediate electrode set at say, 130 kV relative to the cathode, while the electrons are accelerated to a different, or higher energy, by additional anode potential stages.

Advantages of the new design include the following:

A. Ground Potential Modulation

The high energy electron beam is controlled by a low power control pulse which functions just above the potential of the anode structure and the electron beam line, which are conventionally grounded. No high voltage control circuitry is required in the cathode circuit which may be a dc supply. The beam current may also be modulated in amplitude at constant voltage if desired.

B. Simplified Thermo-Mechanical Design

Fabrication is greatly simplified as compared to arrangements employing a thermionic cathode, because the room temperature cathode does not over heat connecting systems, does not undergo severe thermal expansion relative to the other structures, does not require a heater, can operate in low pressure atmospheres and is not easily poisoned.

C. Beam Profile Control and Low Aberration.

Starting with a conventional Pierce electron gun geometry the capability for high electron optical quality is facilitated by providing ion bombardment of the cathode with ions generated at the anode. The ion bombardment flux may be tailored by altering the electrode shapes. The resulting electron density distribution may be adjusted to correspond to a profile optimum for the application. Additionally, the presence of ionic space charge in the region of the axial anode hole tends to reduce astigmatism by effectively extending the anode equipotential surface more smoothly across the central opening through which the beam passes.

D. Differential Pumping.

Low pressure gas does not interfere with the overall function of the plasma-anode electron gun. In order to operate the gun, gas may be inserted into the plasma source section, where a pressure is required, in the order of 30 milliTorr of helium. The gas diffuses through the grids and, if required by the application, may be pumped out at convenient locations around the outer perimeter of the anode and along the axial wall of the anode. The gas pressure in the high voltage region is maintained well below the Paschen-breakdown level, and the effect of ionization produced by high energy electron bombardment will therefore be minimal. Furthermore, the hollow anode (as opposed to a hollow cathode) does not pose a gas breakdown problem and the distance used in estimating the Paschen-breakdown length is that of the interior of the high voltage section and along the insulators. Plasma may be excluded from the anode section or may also be arranged to be present within the center of the electron beam region within the anode for the purpose of reducing the effects of electronic space charge of the beam itself.

Other objects, features, and advantages of the present invention will become apparent from a consideration of the following detailed description and from the accompanying drawings.

DETAILED DESCRIPTIION

Figure 1:
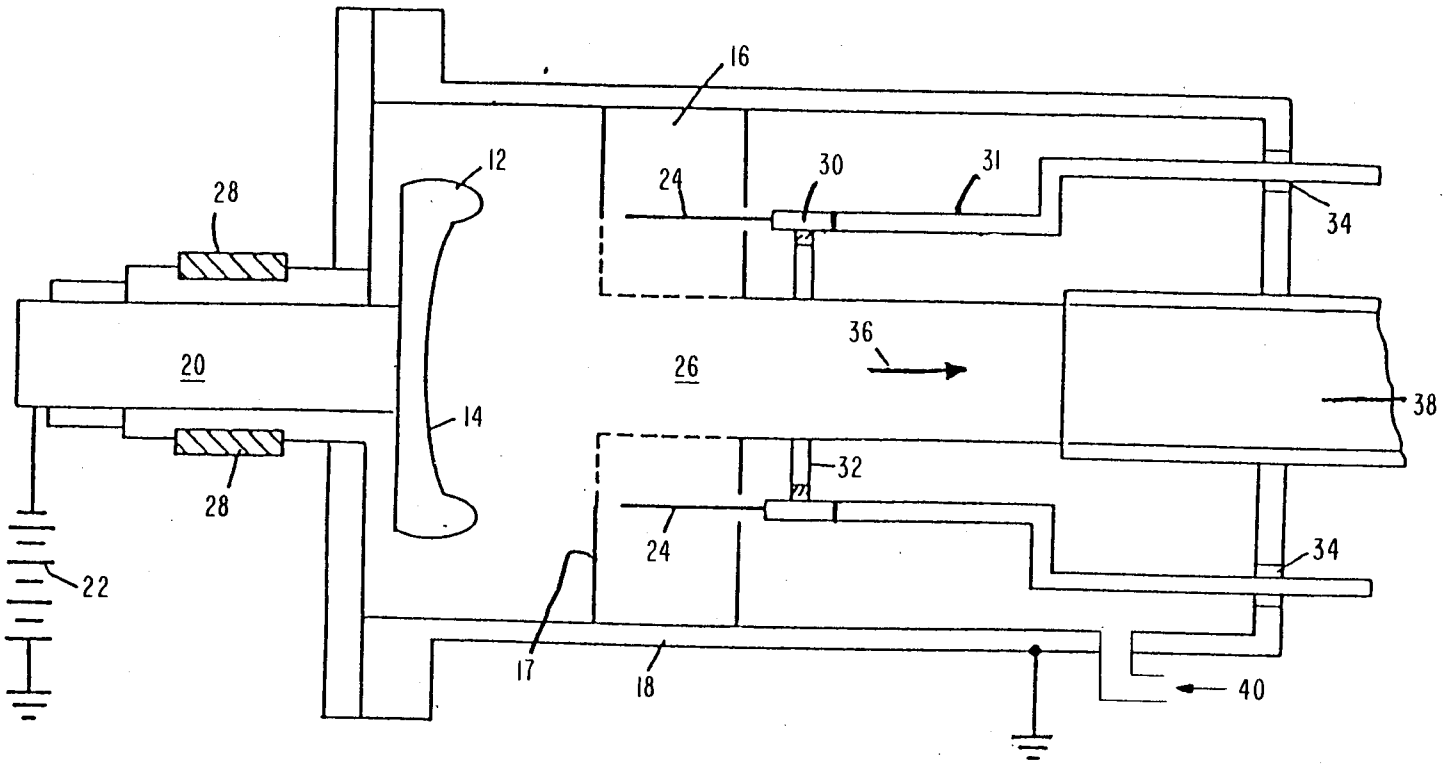
FIG. 1 is a schematic cross-sectional view of a plasma-anode electron beam forming assembly illustrating the principles of the present invention.

Referring more particularly to the drawings, FIG. 1 shows a plasma-anode electron gun constructed according to the principles of the present invention.

In FIG. 1, the cathode 12 may be formed of a material with a high secondary yield such as molybdenum, or have a heavy coating of molybdenum on the dished cathode surface 14, which is of Pierce electron gun form. Ions are generated by the ionization of gas, such as hydrogen, helium or oxygen, which is introduced into the chamber 16 at inlet 40. The outer housing 18 of the plasma-anode electron beam structure may be grounded, and a very substantial negative potential is applied to the cathode 12 through the conductor 20. This negative potential, indicated schematically by the dc voltage source 22, may be the order of 30,000 or 40,000 volts as used in certain tests which have been conducted; but may well be at a potential in the order of minus 100,000 to 500,000 volts in practical embodiments for reasons to be developed below.

Figure 2:
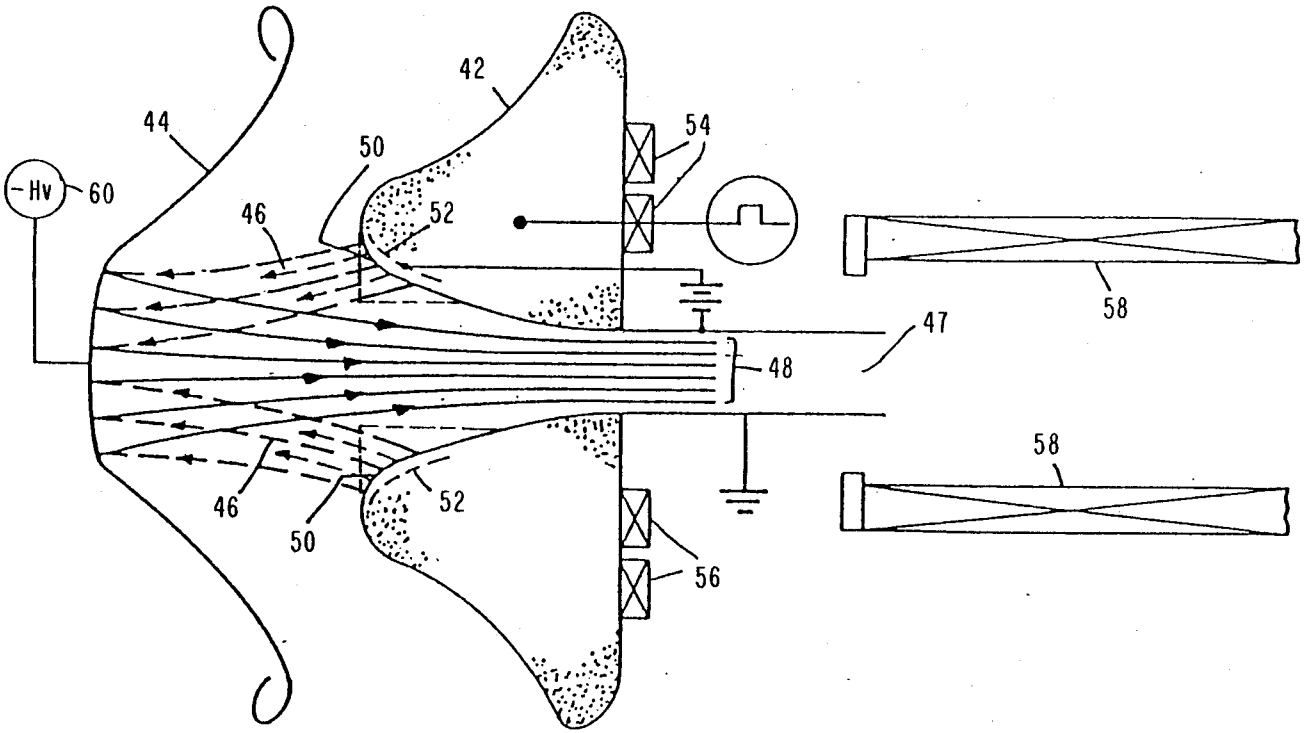
FIG. 2 is a diagrammatic showing of the electrical control arrangements for a plasma-anode electron gun similar to that of FIG. 1.
Figure 5:
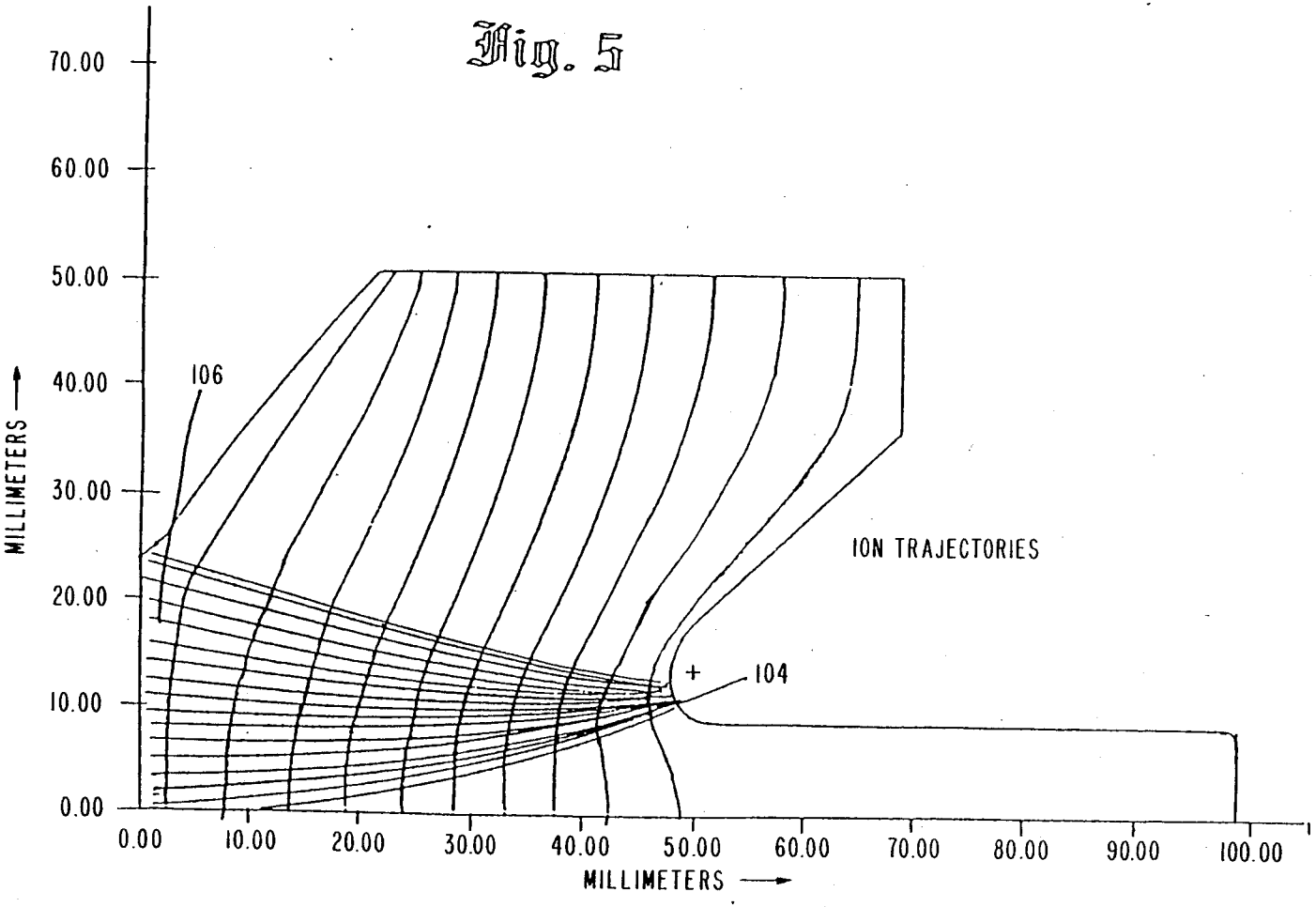
FIGS. 5 and 6 show the ion and the electron trajectories, respectively, for a plasma-anode electron gun of the present type.
Figure 6:
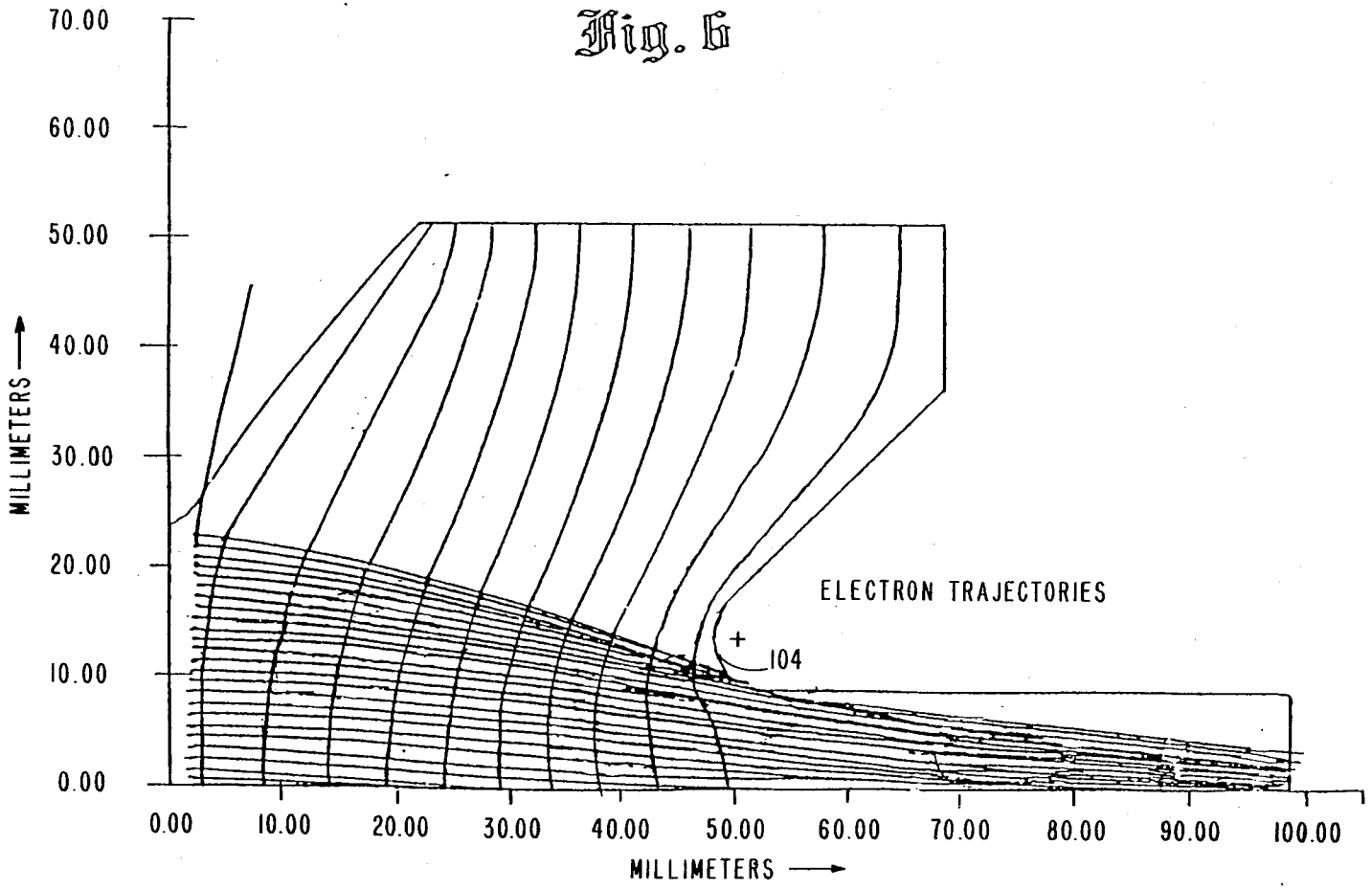

The relatively low pressure gas which is supplied to the chamber 16 may be ionized by an initial pulse, perhaps of 1000 volts, applied on the wire electrodes 24 which extend into the chamber 16. Following initial ionization, the potential on the wire electrodes 24 may drop back to perhaps 300 volts to maintain ionization. The combined ion source chamber 16 and anode 17 is generally annular in its configuration and has a central opening 26 through which the electron beam passes, with the trajectories being substantially as shown in FIGS. 2, 5 and 6. Concerning other features of FIG. 1, it may be noted that the insulating cathode bushing 28 isolates the cathode 12 and its input connector 20 from the housing 18. Similarly, the wire electrodes 24 may be mounted on the support ring 30 which may include several relatively heavy conductors 31 connected together by support ring 32 and having insulating bushings 34 at the point where conductors 31 pass through the enclosing shell 18. The electron beam, indicated generally by the arrow 36, may pass through the passageway 38 for use with electronic devices or structures, not shown, to the right of FIG. 1.

FIG. 2 is a diagrammatic showing of a preferred arrangement of the ion source chamber 42 and the cathode 44. In FIG. 2 the trajectories of the ions are indicated generally by the dashed lines 46, and the trajectories of the electrons which are generated when the ions impact on the cathode 44, are indicated at 48 by the solid lines. The openings 50 for the ions are shown angled toward the cathode 44 to force the ions to follow the trajectories indicated by the dashed lines 46. In tests, it had been determined that there would be a certain amount of leakage of ions from the openings 50, as long as ionization was maintained within the chamber 42. Accordingly, to prevent such undesired leakage, a supplemental grid 52 may be provided. With this grid permanently biased at a relatively small negative potential such as about 70 volts with respect to the openings 50, the undesired leakage of the positive ions is prevented, as described in my prior application Ser. No. 06/621,420, filed on June 18, 1984.

If desired, small permanent magnets 54 and 56 may be provided to reduce the mean free path of ions within the chamber 42, and to facilitate ionization of the gas in this chamber. In this connection, reference is made to my prior U.S. Pat. No. 4,247,804, in which this principle is utilized. Also shown in FIG. 2 is a portion of a solenoid magnet 58 which may provide a supplemental focusing field for the electron beam 48, if such additional focusing is required or desired for the application under consideration. However, space charge neutralization of the electron beam is provided by any residual plasma purposely injected into the drift region 47 of the anode. The availability of this beam focusing capability is an important feature of for traveling wave tube or free electron laser (FEL) types of applications and can be used to provide a collimated beam.

Figure 3:
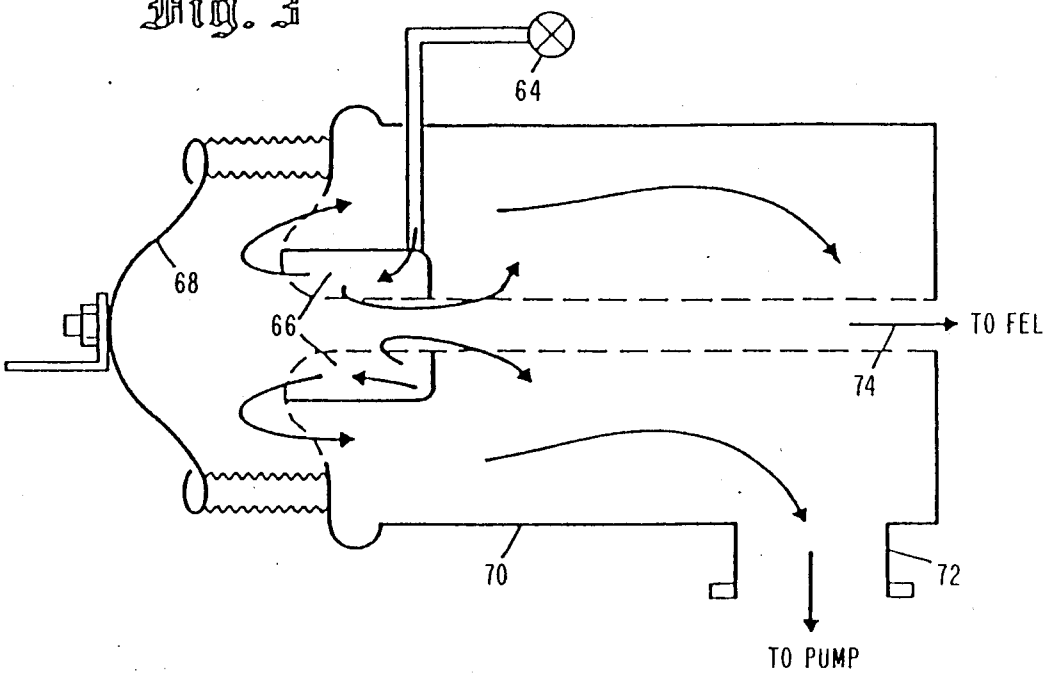
FIG. 3 illustrates diagrammatically one gas control arrangement applicable to plasma-anode electron guns of the present type.

FIG. 3 is a schematic showing of the gas control arrangement which may be employed in the course of the implementation of the present invention for applications where residual gas is not desired down stream of the electron gun. More specifically, helium gas is supplied through the leak valve 64 to the annular ionization chamber 66. Within the plasma source section 66 a finite pressure is required, in the order of about 30 milliTorr of helium. The gas diffuses through the structure as indicated in FIG. 3, and is pumped out at convenient locations around the outer perimeter of the grounded anode 70 and along the axial wall of the anode, as indicated by the fitting 72. Incidentally, the arrow 74 indicates the electron beam being directed to an associated FEL.

Figure 4:
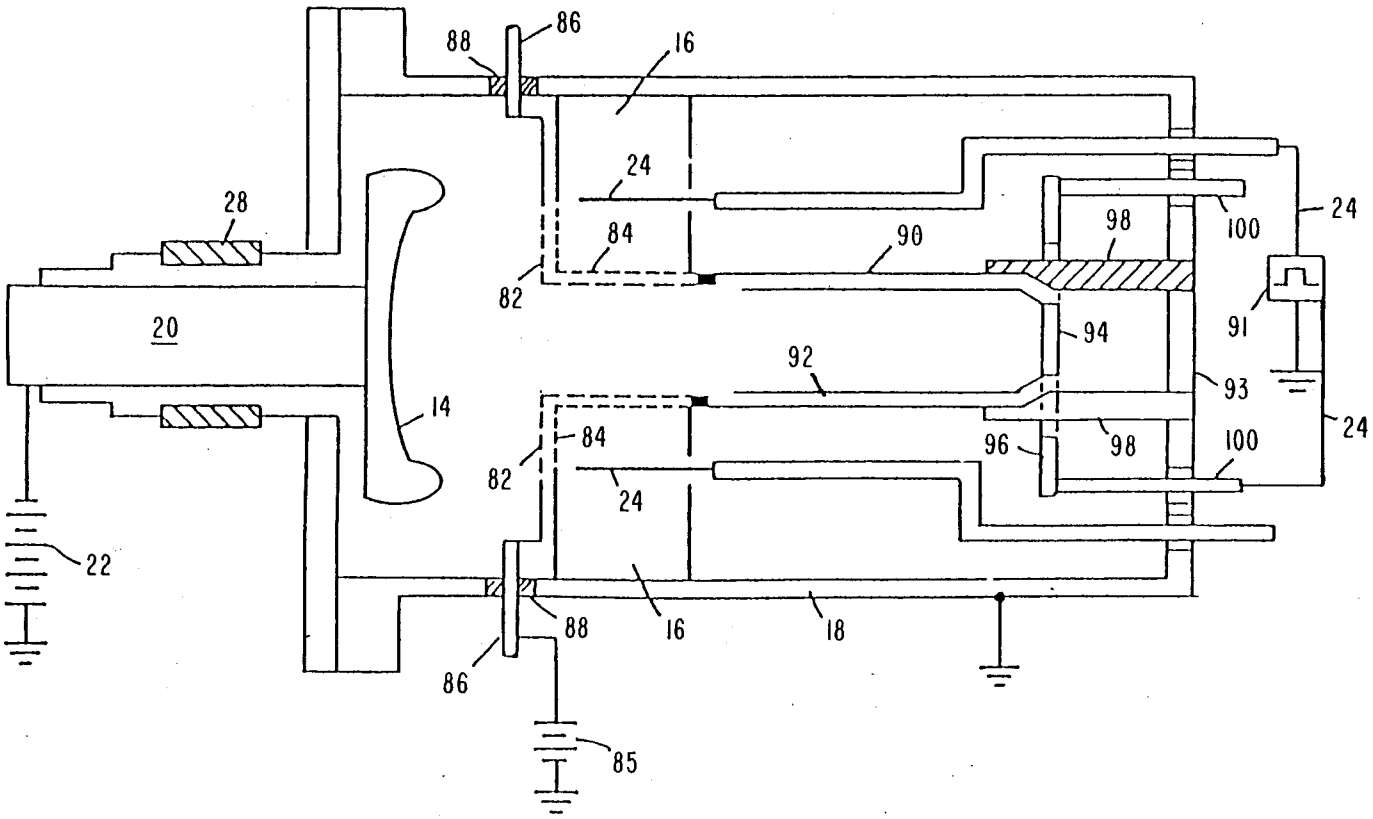
FIG. 4 is a diagrammatic showing of a plasma-anode electron beam forming gun utilizing a supplemental grid associated with the ion source.

The arrangement of FIG. 4 is similar to that of FIG. 1, and corresponding elements in the two figures will bear corresponding numbers, and not be further explained. One important difference in the arrangement of FIG. 4 is the provision of a separate grid 82 outside of the openings 84 in the chamber 16 in which the plasma is formed. The grid 82 is maintained at a slight positive voltage, such as about 70 volts, by application of this dc biasing voltage, as schematically shown at 5, to the input conductors 86. Suitable insulating bushings 88 are provided around the conductors 86. A suitable "Faraday cup" 90 is provided to absorb the electron beam, for the purposes of measuring the electron beam current in the structure shown in FIG. 4. Incidentally, the walls of the Faraday cup 90 extending back toward the cathode 14, tend to capture all of the electrons including secondary electrons which may be generated, and avoid interaction between the absorbed electron beam and the functioning of the ion source and the cathode. In one set of tests which were conducted, the cathode 14 was at a potential of approximately minus 35 kilovolts relative to the grounded ion source or anode, the cathode current was approximately 1.5 amperes, and the beam current as sensed at the Faraday cup, was approximately 1.25 amperes. A pulse source 91 provides short positive pulses in the order of one kilovolt to the wire electrodes 24 to release the ions and pulse the electron beam. By way of example, one structure, had an outer diameter of housing 18, as shown in FIGS. 1 and 4, of about 9.5 centimeters, and the other parts are drawn substantially to scale.

Higher cathode voltages, well in excess of minus 100,000 kilovolts, may be employed in all of the embodiments shown herein, so that a substantially higher ratio of secondary electrons to incident ions is obtained (see FIG. 9) and therefore higher beam currents and current densities would be achieved.

Concerning the physical support and electrical connections to the Faraday cup 90 and the metal sleeve 2 forming part of the anode structure, the right-hand end 94 of the Faraday cup 90 may be formed as part of an apertured plate 96 through which a number of metal legs 98 may extend to support the outer sleeve 90 of the anode. The heavy conductors 100 support the plate 96, and provide electrical connection to the inner sleeve 92; they extend through the end plate 93, using insulating bushings.

Referring to FIGS. 5 and 6, they show typical ion trajectories, and electron trajectories, respectively, for plasma-anode guns of the general configuration shown in FIGS. 1 through 4. In FIG. 5, the source of ions is indicated at reference numeral 104, with the cathode being indicated by the area 106. For the purposes of FIG. 5, the dimensions are given in millimeters, and it is assumed that the cathode is at a potential of approximately 400 kilovolts negative with respect to the grounded anode or the source of ions. Under these conditions, the ion current carried by the positively charged helium ions would be approximately 7.2 amperes, which is the space charge limit. With regard to the electron trajectories which are shown in FIG. 6, the electrons are focused toward a point well beyond the ion source 104. In addition, the beam current is estimated to be approximately 106 amperes, which is again space charge limited. In the calculation, the ratio of secondary emission electrons per incident ion is taken to be 14.7. Adding curvature to the plasma region of the cathode 106 in FIGS. 5 and 6 will alter the focusing of the electron beam and allow for the generation of laminar trajectories which do not strike the anode according to the Pierce electron gun art.

Figure 7:
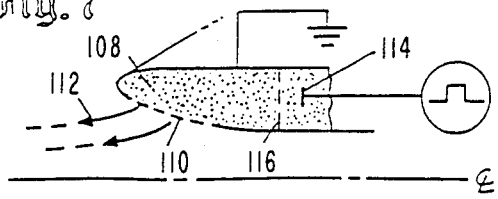
FIG. 7 shows an alternative ion source arrangement.

FIG. 7 is a fragmentary view of one portion of an ion source 108 which may be employed with the plasma-anode beam geometries of FIGS. 1 through 4 as well as 10 and 11. More specifically, FIG. 7 is a cross-sectional view through one portion of an annular ion source. The ion source 108 has the usual openings 110 to permit the release of ions, as indicated by the arrows 112 when a positive pulse in the order of 1 kilovolt is applied to the electrode 114. The apertured baffle plate 116 establishes a hollow cathode discharge chamber in the volume to the left of the baffle, as shown in FIG. 7. Thus, for example, following an initial ionization pulse close to 1000 volts, the normal energization of electrode 114 may be in the order of 200 volts. Then, when a one kilovolt pulse is applied to electrode 114, the chamber 108 will be ionized, and the ions 112 will be released through the openings 110 of the ion source.

Figure 8:
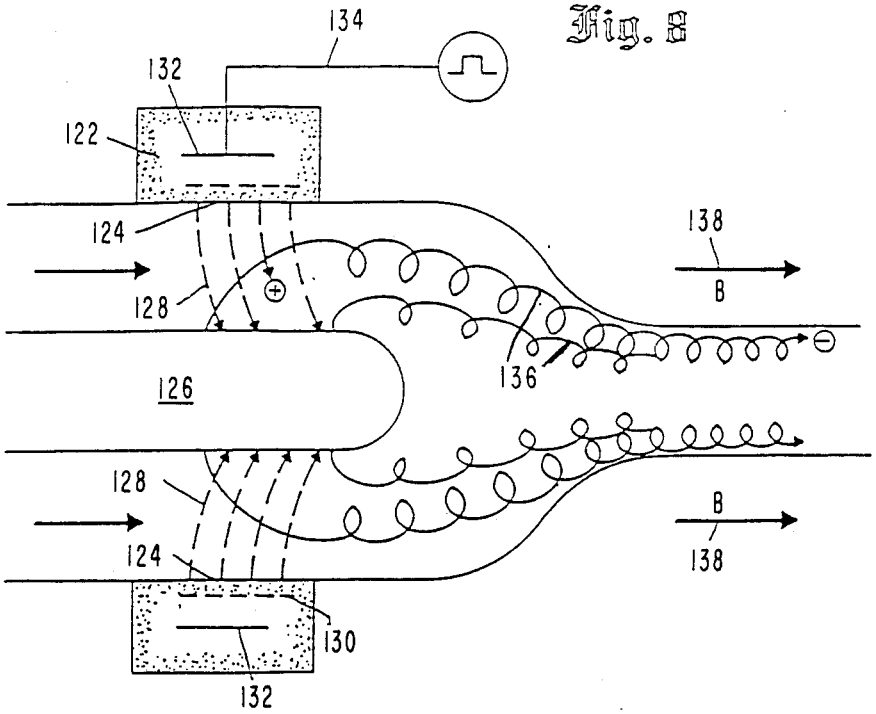
FIG. 8 is a diagrammatic showing of an alternative embodiment illustrating the principles of the invention as applied to the gyrotron.

FIG. 8 shows an alternative embodiment of the invention applicable to gyrotron-type structures. Incidentally, one representative article discussing free electron lasers and gyrotrons is entitled "New Sources of High Power Coherent Radiation", and it appeared in the March 1984 issue of *Physics Today*, pages 44 through 51. In FIG. 8, the plasma ion source 122 is annular in its configuration and has openings on its inner surface 124 facing the cathode 126. As in the case of the embodiments of FIGS. 1 through 4, for example, the cathode 126 may be formed of molybdenum or have a heavy coating of molybdenum on the area where the ions, indicated by dashed lines 128, will impact. As in the case of prior arrangements, the optional grid 130 may be biased to a fairly low negative potential such as about 70 volts in order to avoid the leakage of helium ions following the desired pulse. An additional electrode 132, which may also be annular, is energized from lead 134. In order to ionize the helium gas in the chamber 122, a magnetic field of the order of several hundred Gauss or more extends from the stronger gyrotron region 138 into the chamber 122 and an initial pulse of 800 or 1,000 volts may be applied to electrode 132 on lead 134 causing a crossed field discharge to occur in chamber 122. Following ionization, the voltage may be dropped back to about 300 volts to maintain ionization. This process is used when it is desired to release ions from the screen 124. A control pulse, which may be in the order of 1,000 volts, is applied to the electrode 132, and this overcomes the positive bias applied to grid 130, and ions are released as indicated by the dashed lines 128. Secondary electrons 136 are released from the surface of the cathode 26, and as a result of the axial magnetic field indicated by the arrows 138, designated B, the electrons follow the approximate indicated paths 136.

Figure 9:
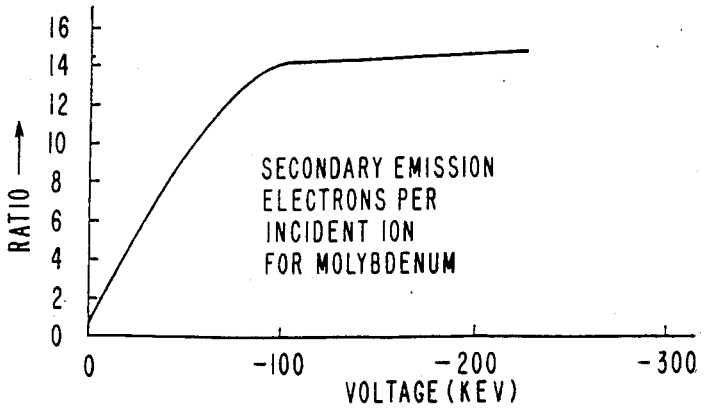
FIG. 9 is a relatively crude plot of secondary emission electrons per incident helium ion for molybdenum, plotted against the energy of the incoming ions in kilovolts.

FIG. 9 is a schematic plot of the secondary emission of electrons from a molybdenum cathode, when bombarded with ions, plotted against the cathode voltage in kilovolts. It may be noted that the secondary emission increases rapidly with increasing negative voltages, up to about 100,000 volts, and thereafter only has a slight positive slope. Finally at voltages in the order of 1,000,000 volts a downturn in the ratio occurs.

Figure 10:
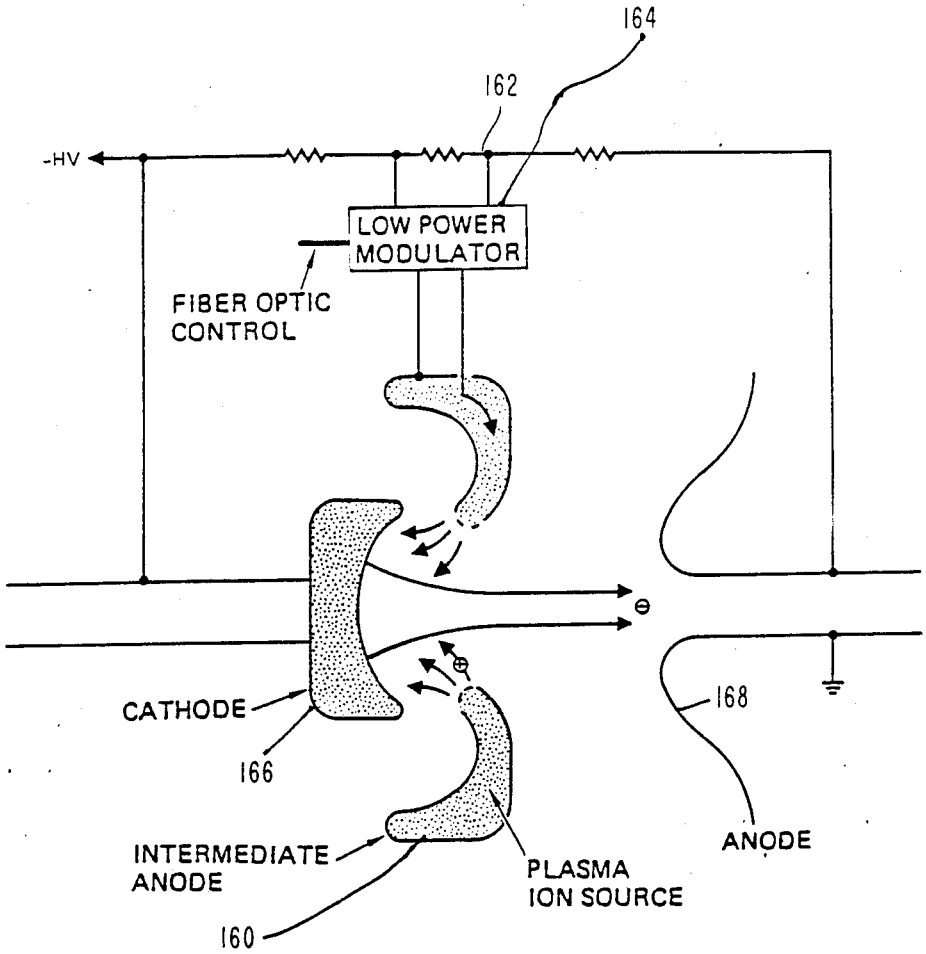
FIG. 10 indicates a modification allowing for independently adjustable ion and electron energies for operation at voltages well above 100 kV.

FIG. 10 shows how take best advantage of the secondary emission mechanism without introducing excessive heating or sputtering; it is possible to utilize an ion source located within an auxiliary electrode 160 held at some intermediate potential between the cathode 166 and anode 168 by an external circuit 162 which also powers a low power trigger modulator 164 and is activated by fiber optic control pulses.

Figure 11:
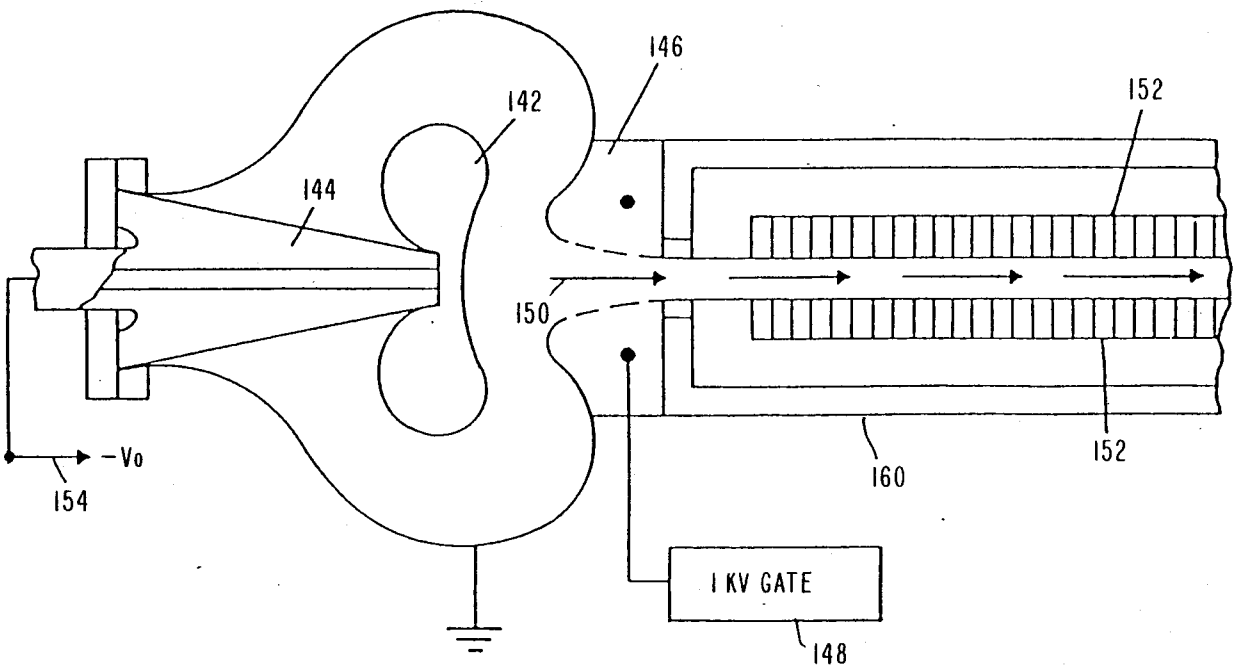
FIG. 11 indicates diagrammatically how the present invention may be employed to provide an electron beam for a free electron laser or modulator.

FIG. 11 is a schematic showing of a modified embodiment of the invention in which the cold cathode 142 is mounted on a conical support 144 in opposition to the ion source 146. The source of gating pulses 148 is similar to that described hereinabove, and includes arrangements for initially ionizing the gas, for maintaining the ionization, and subsequently periodically pulsing the plasma to an elevated potential so that ions are released to impinge on the cathode 142 and to generate an electron beam, as indicated generally by the arrow 150. A free electron laser or modulator 160 is indicated generally to the right in FIG. 11, with the so-called "wiggler" permanent magnets being shown at reference numeral 152. Also shown in FIG. 11 is the normal high voltage supply −Vo directed to lead 154, supplying perhaps a negative 250,000 kilovolts to the cathode 142.

In conclusion, it is to be understood that the foregoing detailed description and the accompanying drawings relate to illustrative embodiments of the invention. Various modifications may be made, without departing from the spirit and scope of the invention. Thus, by way of example and not of limitation, any of the grid and excitation arrangements, and the axial magnetic field arrangements, shown in connection with various embodiments may be employed in combination with arrangements shown in other figures of the drawings. Thus, the negatively or positively biased control grid may be either within or just outside of the ionization chamber, and the resulting electron beam may be employed in connection with any known electron beam devices. In addition, instead of using a continuous annular ion source, several separate spaced ion sources could be employed to accomplish substantially the same function. Also, the symmetry of the device may be arranged to be linear as well as the axially symmetric arrangements shown in the figures. Accordingly, the present invention is not limited to the embodiments precisely as shown and described hereinabove.

What is claimed is:

1. A plasma-anode electron gun assembly comprising:

a cathode formed of a material that emits secondary electrons in a ratio to incident ions sufficiently high to provide a predetermined current requirement;

a combined anode and ion source electrode structure, said structure including a substantially ring-shaped hollow chamber having a radially inner surface which forms a passageway for secondary electrons emitted from said cathode;

means for generating an ion plasma in said ring-shaped hollow chamber;

means for biasing said cathode to a substantial negative potential with respect to said combined anode and ion source structure;

means for selectively releasing ions from said ring-shaped hollow chamber to impinge upon said cathode; and means for directing secondary electrons released from said cathode through said passageway in said ring-shaped hollow chamber.

2. A plasma-anode electron gun assembly as defined in claim 1 wherein said cathode has a molybdenum surface.

3. A plasma-anode electron gun assembly as defined in claim 1 wherein said combined anode and ion source structure has an array of openings facing said cathode.

4. A plasma-anode electron gun assembly as defined in claim 3 wherein a grid is located immediately adjacent said openings, and menas are provided for biasing said grid positively with respect to said combined anode and ion source structure.

5. A plasma-anode electron gun assembly as defined in claim 1 including means for applying a negative potential to the cathode relaltive to said combined anode and ion source structure of 50,000 volts or more.

6. A plasma-anode electron gun assembly as defined in claim 1 wherein said means for releasing ions includes an electrode within the ring-shaped hollow chamber and means for applying a substantial positive voltage to said electrode.

7. A plasma-anode electron gun assembly as defined in claim 6 wherein the electrode is a fine wire or wires.

8. A plasma-anode electron gun assembly as defined in claim 6 wherein the electrode is a plate and an auxiliary magnetic field is applied to the ring-shaped hollow chamber by magnets.

9. A plasma-anode electron gun assembly as defined in claim 6 wherein the electrode is contained in a separate chamber connected to the plasma ring-shaped hollow chamber by a hole with the ion source ring-shaped hollow chamber providing a hollow cathode configuration.

10. A plasma-anode electron gun assembly as defined in claim 1 wherein said cathode is located on the axis of said assembly aligned with the passageway of said ring-shaped hollow chamber, and said cathode has a slightly dished surface facing toward said ring-shaped hollow chamber.

11. A plasma-anode electron gun assembly as defined in claim 1 including means for applying an axial magnetic field to focus the electrons generated at said cathode.

12. A plasma-anode electron gun assembly as defined in claim 1 wherein said cathode is generally cylindrical in its configuration, and wherein said combined anode and ion source structure is positioned around said cathode.

13. A plasma-anode electron gun assembly as defined in claim 1 wherein said ring-shaped hollow chamber includes two plasma volumes intercoupled by one or more openings, one of said volumes closer to said cathode being provided with an array of openings facing said cathode to release ions to impinge on said cathode, at lease one control electrode extending into the second of said volumes, and means for applying substantial positive voltage pulses to said control electrode to cause the release of ions to impinge on said cathode.

14. A plasma-anode electron gun assembly comprising:

a cathode formed of a materal having a high ratio of secondary electrons to incident ions;

a combined anode and ion source electrode structure, said structure including a substantially ring-shaped hollow chamber having a radially inner surface which forms a passageway for the secondary electrons emitted from the cathode;

means for maintaining a low pressure gas in said ring-shaped hollow chamber;

means for generating an ion plasma in said ring-shaped hollow chamber;

means for biasing said cathode to a substantial negative potential with respect to said combined anode and ion source structure;

means for selectively releasing ioins from said ring-shaped hollow chamber to impinge upon said cathode;

means for directing secondary electrons released from said cathode through said passageway in said ring-shaped hollow chamber; and said cathode having a slightly dished surface spaced along the axis of the assembly from, and facing, said combined ion source and anode structure.

15. A plasma-anode electron gun assembly as defined in claim 14 wherein said cathode has a molybdenum surface.

16. A plasma-anode electron gun assembly as defined in claim 14 wherein said low pressure gas is helium.

17. A plasma-anode electron gun assembly as defined in claim 14 wherein said low pressure gas is oxygen.

18. A plasma-anode electron gun assembly as defined in claim 14 wherein said combined anode and ion source structure has an array of openings facing said cathode.

19. A plasma-anode electron gun assembly as defined in claim 18 wherein a grid is located immediately adjacent said openings, and means are provided for biasing said grid positively with respect to said combined anode and ion source structure.

20. A plasma-anode electron gun assembly as defined in claim 14 including means for applying a negative potential to the cathode relative to said combined anode and ion structure of 100,000 volts or more.

21. A plasma-anode electron gun assembly as defined in claim 14 wheren said means for releasing ions includes an electrode within the ring-shaped hollow chamber and means for applying a substantial positive voltage to said electrode.

22. A plasma-anode electron gun assembly as defined in claim 14 wherein said ring-shaped hollow chamber includes means for comfining two plasma volumes, intercoupled by one or more openings, one of said volumes closer to said cathode being provided with an array of openings facing said cathode to release ions to impinge on said cathode, at least one control electrode extending into the second of said volumes, and means for applying substantial positive voltage pulses to said control electrode to cause the relesae of ions to impinge on said cathode.

23. A plasma-anode electron gun assembly comprising:

a cathode formed of a material having a high ratio of secondary electrons to incident ions;

a combined anode and ion source electrode structure, said structure including a ring-shaped hollow chamber having a radially inner surface which forms a passageway for the secondary electrons emitted from the cathode;

means for maintaining a low pressure gas within said structure;

means for generating an ion plasma in said ring-shaped hollow chamber;

means for biasing said cathode to a substantial negative potential having a potential difference greater than 30,000 volts with respect to said combined anode and ion source structure;

means for selectively releasing ions from said ring-shaped hollow chamber to impinge upon said cathode with said ions following predetermined trajectories; and means for directing secondary electrons released from said cathode through said passageway in said ring-shaped hollow chamber along trajectories substantially different from the predetermined ion trajectories.

24. A plasma-anode electron gun assembly as defined in claim 23 wherein said assembly includes means for directing said ions inwardly toward said cathode, and means for directing said electrons to form a beam along the axis of said cathode and said gun assembly.

25. A plasma-anode electron gun assembly as defined in claim 23 wherein said cathode is generally cylindrical in its configuration, and wherein said anode and ion source structure is positioned around said cathode.

* * * * *